US009051163B2

(12) United States Patent
Mehus et al.

(10) Patent No.: US 9,051,163 B2
(45) Date of Patent: Jun. 9, 2015

(54) AUTOMATIC CALIBRATION OF CHEMICAL PRODUCT DISPENSE SYSTEMS

(75) Inventors: Richard J. Mehus, Richfield, MN (US); Brian L. Sholes, Minneapolis, MN (US)

(73) Assignee: Ecolab Inc., St. Paul, MN (US)

( * ) Notice: Subject to any disclaimer, the term of this patent is extended or adjusted under 35 U.S.C. 154(b) by 518 days.

(21) Appl. No.: 12/574,111

(22) Filed: Oct. 6, 2009

(65) Prior Publication Data

US 2011/0082595 A1 Apr. 7, 2011

(51) Int. Cl.

| | |
|---|---|
| ***B67D 7/02*** | (2010.01) |
| ***B67D 7/08*** | (2010.01) |
| ***B67D 7/14*** | (2010.01) |
| ***B67D 7/22*** | (2010.01) |
| ***B67D 7/30*** | (2010.01) |

(52) U.S. Cl.

CPC *B67D 7/02* (2013.01); *B67D 7/085* (2013.01); *B67D 7/145* (2013.01); *B67D 7/224* (2013.01); *B67D 7/303* (2013.01)

(58) Field of Classification Search

None

See application file for complete search history.

(56) References Cited

U.S. PATENT DOCUMENTS

| | | | |
|---|---|---|---|
| 33,861 | A | 12/1861 | Whitney |
| 1,985,615 | A | 12/1934 | Mitchell |
| 2,219,597 | A | 10/1940 | Lutz |
| 2,254,269 | A | 9/1941 | Clark et al. |
| 2,319,739 | A | 5/1943 | Kessler |
| 2,333,791 | A | 11/1943 | Hutchinson |
| 2,594,975 | A | 4/1952 | Mytling |
| 2,679,374 | A | 5/1954 | Mytling |
| 2,714,472 | A | 8/1955 | Richardson |
| 2,990,707 | A | 7/1961 | Gerhardt et al. |
| 3,091,327 | A | 5/1963 | Lalley |
| 3,136,157 | A | 6/1964 | Seed et al. |
| 3,197,980 | A | 8/1965 | Marple |
| 3,412,254 | A | 11/1968 | Meyer-Doering et al. |
| 3,447,906 | A | 6/1969 | Zimmerli |
| 3,526,334 | A | 9/1970 | Ashton et al. |

(Continued)

FOREIGN PATENT DOCUMENTS

| | | | |
|---|---|---|---|
| DE | 3933763 | A1 | 4/1991 |
| DE | 10016659 | A1 | 10/2001 |

(Continued)

OTHER PUBLICATIONS

"ALR-9650 Gen 2 RFID Reader with Integrated Antenna", Alien Technology Corporation, Dec. 2007, (2 pgs.).

(Continued)

*Primary Examiner* — Ryan Jarrett

(74) *Attorney, Agent, or Firm* — Shumaker & Sieffert, P.A.

(57) ABSTRACT

Automatic calibration of dispense parameters of a product dispense system is accomplished via electronic communication of product information. A chemical product includes an electronically readable tag or label that stores and communicates chemical product data concerning the chemical product to a chemical product dispenser. The chemical product data may include, for example, the name of the chemical product, the type or class of the chemical product, manufacturing information regarding the chemical product (e.g., manufacturing date, location, serial number, lot number, etc.), concentration of active ingredient(s), weight, volume, viscosity, density, hardness, specific gravity, shape, color, and/or other data concerning the chemical product. A controller within the dispenser automatically calibrates the dispense parameters based on the chemical product data.

17 Claims, 4 Drawing Sheets

(56) References Cited

U.S. PATENT DOCUMENTS 3,578,094 A 5/1971 Henry et al.
3,653,544 A 4/1972 Young et al.
3,656,478 A 4/1972 Swersey
3,743,598 A 7/1973 Field
3,754,871 A 8/1973 Hessel et al.
3,760,166 A 9/1973 Adams et al.
3,772,193 A 11/1973 Nelli et al.
3,774,056 A 11/1973 Sample et al.
3,796,349 A 3/1974 Weber
3,826,113 A 7/1974 Noraas et al.
3,826,408 A 7/1974 Berndt et al.
3,828,869 A 8/1974 Sellers et al.
3,834,587 A 9/1974 Bengt et al.
4,040,515 A 8/1977 Hessel et al.
4,046,996 A 9/1977 Williams et al.
4,076,146 A 2/1978 Lausberg et al.
4,195,500 A 4/1980 Tobita et al.
4,199,001 A 4/1980 Kratz
4,211,517 A 7/1980 Schmid
4,219,089 A 8/1980 Gard et al.
4,222,496 A 9/1980 Start et al.
4,241,400 A 12/1980 Kiefer
4,247,396 A 1/1981 Buesing
4,265,266 A 5/1981 Kierbow et al.
4,307,787 A 12/1981 Raboud et al.
4,320,855 A 3/1982 Ricciardi et al.
4,334,784 A 6/1982 Engels
4,353,482 A 10/1982 Tomlinson et al.
4,373,418 A 2/1983 Rhodes et al.
4,396,828 A 8/1983 Dino et al.
4,402,426 A 9/1983 Faulkner et al.
4,404,639 A 9/1983 McGuire et al.
4,433,917 A 2/1984 Mendel et al.
4,463,844 A 8/1984 Huffman et al.
4,482,785 A 11/1984 Finnegan et al.
4,486,910 A 12/1984 Saalmann et al.
4,509,543 A 4/1985 Livingston et al.
4,513,796 A 4/1985 Miller et al.
4,526,215 A 7/1985 Harrison et al.
4,573,606 A 3/1986 Lewis et al.
RE32,101 E 4/1986 Ricciardi et al.
RE32,102 E 4/1986 Ricciardi et al.
4,597,091 A 6/1986 Blake
4,630,654 A 12/1986 Kennedy, Jr.
4,632,198 A 12/1986 Uchimura
4,660,667 A 4/1987 Uchimura et al.
4,676,399 A 6/1987 Burckhardt
4,690,230 A 9/1987 Uchimura et al.
4,690,305 A 9/1987 Copeland
4,697,243 A 9/1987 Moore et al.
4,707,848 A 11/1987 Durston et al.
4,711,370 A 12/1987 Goudy, Jr. et al.
4,733,971 A 3/1988 Pratt
4,756,321 A 7/1988 Livingston et al.
4,766,548 A 8/1988 Cedrone et al.
4,770,859 A 9/1988 Heiser, Jr.
4,789,014 A 12/1988 DiGianfilippo et al.
4,826,661 A 5/1989 Copeland et al.
4,830,508 A 5/1989 Higuchi et al.
4,834,546 A 5/1989 Pütz
4,836,685 A 6/1989 Verreault
4,837,811 A 6/1989 Butler et al.
4,843,579 A 6/1989 Andrews et al.
4,845,965 A 7/1989 Copeland et al.
4,848,381 A 7/1989 Livingston et al.
4,858,449 A 8/1989 Lehn
4,867,196 A 9/1989 Zetena et al.
4,867,343 A 9/1989 Ricciardi et al.
4,872,763 A 10/1989 Higuchi et al.
4,908,190 A 3/1990 Maglio et al.
4,938,240 A 7/1990 Lakhan et al.
4,944,428 A 7/1990 Gmür
4,961,887 A 10/1990 Crumpler et al.
4,964,185 A 10/1990 Lehn
4,967,811 A 11/1990 DiGianfilippo et al.
4,969,011 A 11/1990 Faull et al.
4,974,646 A 12/1990 Martin et al.
4,976,137 A 12/1990 Decker et al.
4,980,292 A 12/1990 Elbert et al.
4,999,124 A 3/1991 Copeland
5,006,995 A 4/1991 Toschi et al.
5,014,211 A 5/1991 Turner et al.
5,014,877 A 5/1991 Roos
5,024,352 A 6/1991 Gmür et al.
5,036,479 A 7/1991 Prednis et al.
5,038,807 A 8/1991 Bailey et al.
5,038,973 A 8/1991 Gmür
5,040,699 A 8/1991 Gangemi
5,043,860 A 8/1991 Koether et al.
5,053,206 A 10/1991 Maglio et al.
5,064,094 A 11/1991 Roos et al.
5,115,842 A 5/1992 Crafts et al.
5,136,281 A 8/1992 Bonaquist
5,147,615 A 9/1992 Bird et al.
5,158,895 A 10/1992 Ashihara et al.
5,203,366 A 4/1993 Czeck et al.
5,208,930 A 5/1993 Chabard
5,219,224 A 6/1993 Pratt
5,222,027 A 6/1993 Williams et al.
5,240,326 A 8/1993 Evanson
5,268,153 A 12/1993 Muller
5,279,448 A 1/1994 Hanlin et al.
5,283,639 A 2/1994 Esch et al.
5,288,145 A 2/1994 Mackey et al.
5,294,022 A 3/1994 Earle
5,316,195 A 5/1994 Moksnes et al.
5,322,571 A 6/1994 Plummer et al.
5,332,311 A 7/1994 Volk, Jr. et al.
5,332,312 A 7/1994 Evanson
5,340,211 A 8/1994 Pratt
5,345,379 A 9/1994 Brous et al.
5,369,032 A 11/1994 Pratt
5,370,267 A 12/1994 Schroeder
5,389,344 A 2/1995 Copeland et al.
5,390,385 A 2/1995 Beldham
5,397,028 A 3/1995 Jesadanont
5,400,018 A 3/1995 Scholl et al.
5,404,893 A 4/1995 Brady et al.
5,407,598 A 4/1995 Olson et al.
5,411,716 A 5/1995 Thomas et al.
5,419,355 A 5/1995 Brennan et al.
5,427,748 A 6/1995 Wiedrich et al.
5,448,499 A 9/1995 Palmer
5,495,962 A 3/1996 Nomura
5,497,914 A 3/1996 Maltsis
5,500,050 A 3/1996 Chan et al.
5,505,915 A 4/1996 Copeland et al.
5,556,478 A 9/1996 Brady et al.
5,558,435 A 9/1996 Marjo
5,580,448 A 12/1996 Brandreth, III
5,581,982 A 12/1996 Schroeder et al.
5,584,025 A 12/1996 Keithley et al.
5,584,079 A 12/1996 Wong et al.
5,609,417 A 3/1997 Otte
5,619,183 A 4/1997 Ziegra et al.
5,625,659 A 4/1997 Sears
5,625,908 A 5/1997 Shaw
5,632,411 A 5/1997 Harty et al.
5,636,008 A 6/1997 LoBiondo et al.
5,638,417 A 6/1997 Boyer et al.
5,653,269 A 8/1997 Miller et al.
5,671,262 A 9/1997 Boyer et al.
5,679,173 A 10/1997 Hartman
5,681,285 A 10/1997 Ford et al.
5,681,400 A 10/1997 Brady et al.
5,694,323 A 12/1997 Koropitzer et al.
5,695,091 A 12/1997 Winings et al.
5,724,261 A 3/1998 Denny et al.
5,745,381 A 4/1998 Tanaka et al.
5,757,664 A 5/1998 Rogers et al.
5,758,300 A 5/1998 Abe
5,759,501 A 6/1998 Livingston et al.
5,761,278 A 6/1998 Pickett et al.
5,762,096 A 6/1998 Mirabile

(56) References Cited

U.S. PATENT DOCUMENTS 5,769,536 A 6/1998 Kotylak
5,777,895 A 7/1998 Kuroda et al.
H1743 H 8/1998 Graves et al.
5,821,523 A 10/1998 Bunte et al.
5,826,749 A 10/1998 Howland et al.
5,827,486 A 10/1998 Crossdale
5,839,097 A 11/1998 Klausner
5,851,291 A 12/1998 Poterala et al.
5,861,881 A 1/1999 Freeman et al.
5,864,783 A 1/1999 Struck et al.
5,875,430 A 2/1999 Koether
5,885,446 A 3/1999 McGrew, Jr.
5,887,975 A 3/1999 Mordaunt et al.
5,897,671 A 4/1999 Newman et al.
5,902,749 A 5/1999 Lichtwardt et al.
5,913,915 A 6/1999 McQuinn
5,931,877 A 8/1999 Smith et al.
5,933,479 A 8/1999 Michael et al.
5,938,074 A 8/1999 Dartus
5,939,974 A 8/1999 Heagle et al.
5,945,910 A 8/1999 Gorra
5,956,487 A 9/1999 Venkatraman et al.
5,961,561 A 10/1999 Wakefield, II
5,967,202 A 10/1999 Mullen et al.
5,969,970 A 10/1999 Rhoades
5,973,696 A 10/1999 Agranat et al.
5,974,345 A 10/1999 Buck et al.
5,975,352 A 11/1999 Spriggs et al.
5,979,703 A 11/1999 Nystrom
5,980,090 A 11/1999 Royal et al.
5,987,105 A 11/1999 Jenkins et al.
5,992,686 A 11/1999 Cline et al.
6,003,070 A 12/1999 Frantz
6,007,788 A 12/1999 Bellon et al.
6,012,041 A 1/2000 Brewer et al.
6,029,286 A 2/2000 Funk
6,049,792 A 4/2000 Hart et al.
6,061,668 A 5/2000 Sharrow
6,073,124 A 6/2000 Krishnan et al.
6,082,149 A 7/2000 Woods
6,098,843 A 8/2000 Soberanis et al.
6,120,175 A 9/2000 Tewell
6,129,449 A 10/2000 McCain et al.
6,133,555 A 10/2000 Brenn
6,136,184 A 10/2000 King
6,143,257 A 11/2000 Spriggs et al.
6,164,189 A 12/2000 Anson
6,167,358 A 12/2000 Othmer et al.
6,176,774 B1 1/2001 Filiberti et al.
6,220,312 B1 4/2001 Hirsch et al.
6,234,218 B1 5/2001 Boers
6,249,778 B1 6/2001 Vaghi
6,259,956 B1 7/2001 Myers et al.
6,269,340 B1 7/2001 Ford et al.
6,269,975 B2 8/2001 Soberanis et al.
6,321,204 B1 11/2001 Kazami et al.
6,330,499 B1 12/2001 Chou et al.
6,356,205 B1 3/2002 Salvo et al.
6,357,292 B1 3/2002 Schultz et al.
6,370,454 B1 4/2002 Moore
6,377,868 B1 4/2002 Gardner, Jr.
6,380,495 B1 4/2002 Ash et al.
6,418,371 B1 7/2002 Arnold
6,438,471 B1 8/2002 Katagishi et al.
6,441,322 B1 8/2002 Ash et al.
6,463,940 B1 10/2002 Thomas et al.
6,472,615 B1 10/2002 Carlson
6,490,513 B1 12/2002 Fish et al.
6,507,966 B1 1/2003 Mitchell et al.
6,513,964 B1 2/2003 Himmelright et al.
6,547,097 B1 4/2003 Cavallaro et al.
6,561,381 B1 5/2003 Osterheld et al.
6,697,706 B2 2/2004 Gardner, Jr.
6,707,873 B2 3/2004 Thompson et al.
6,719,453 B2 4/2004 Cosman et al.
6,792,395 B2 9/2004 Roberts
6,845,298 B2 1/2005 Nelson et al.
6,896,140 B1 5/2005 Perry
6,921,000 B2 7/2005 Wagner et al.
6,987,228 B1 1/2006 MacMichael et al.
7,009,519 B2 3/2006 Leonard et al.
7,069,188 B2 6/2006 Roberts
7,128,215 B2 10/2006 Danechi
7,175,048 B2 2/2007 Wolfschaffner
7,201,290 B2 4/2007 Mehus et al.
7,228,990 B2 6/2007 Schmidt
7,237,577 B1 7/2007 Yacko et al.
7,410,623 B2 8/2008 Mehus et al.
7,530,729 B2 5/2009 O'Callaghan
7,694,589 B2 4/2010 Mehus et al.
7,740,152 B2 * 6/2010 Hughes et al. ..... 222/129.1
7,891,523 B2 2/2011 Mehus et al.
7,896,198 B2 3/2011 Mehus et al.
7,954,668 B2 6/2011 Mehus et al.
8,240,508 B2 8/2012 Wegelin et al.
8,277,745 B2 10/2012 Mehus et al.
8,511,512 B2 8/2013 Mehus et al.
2001/0023841 A1 9/2001 Zimmerman et al.
2001/0038018 A1 11/2001 Bell et al.
2001/0039501 A1 11/2001 Crevel et al.
2001/0047214 A1 11/2001 Cocking et al.
2001/0049846 A1 12/2001 Guzzi et al.
2001/0053939 A1 12/2001 Crevel et al.
2001/0054038 A1 12/2001 Crevel et al.
2002/0014496 A1 2/2002 Cline et al.
2003/0006281 A1 1/2003 Thomas et al.
2003/0031084 A1 2/2003 Bartos
2003/0033156 A1 2/2003 McCall
2003/0033396 A1 2/2003 McCall
2003/0043688 A1 3/2003 Peterson et al.
2003/0121561 A1 7/2003 Wagner et al.
2003/0127110 A1 7/2003 Reichold et al.
2003/0155035 A1 8/2003 Ichikawa et al.
2003/0195656 A1 10/2003 Gardner, Jr. et al.
2004/0015269 A1 1/2004 Jungmann et al.
2004/0088076 A1 5/2004 Gardner, Jr. et al.
2004/0162850 A1 8/2004 Sanville et al.
2004/0216500 A1 11/2004 Aouad
2004/0220844 A1 11/2004 Sanville et al.
2004/0226755 A1 11/2004 Pottebaum et al.
2004/0226956 A1 11/2004 Brooks
2004/0226959 A1 * 11/2004 Mehus et al. ..... 222/1
2004/0230339 A1 11/2004 Maser et al.
2004/0232163 A1 11/2004 Reinsch et al.
2004/0245284 A1 12/2004 Mehus et al.
2005/0065644 A1 3/2005 Gardner, Jr.
2005/0072793 A1 4/2005 Mehus et al.
2005/0102059 A1 5/2005 Gardner, Jr.
2005/0108044 A1 5/2005 Koster
2005/0144737 A1 7/2005 Roepke et al.
2005/0150952 A1 7/2005 Chung
2005/0171634 A1 8/2005 York et al.
2005/0174376 A1 8/2005 Deshmukh et al.
2005/0252930 A1 11/2005 Contadini et al.
2005/0269348 A1 12/2005 Limback et al.
2006/0015536 A1 1/2006 Buchanan et al.
2006/0108415 A1 5/2006 Thomas et al.
2006/0173576 A1 8/2006 Georg et al.
2006/0173896 A1 8/2006 Lyon et al.
2007/0000291 A1 1/2007 France et al.
2007/0131762 A1 6/2007 Dumont
2007/0154370 A1 7/2007 Mehus et al.
2007/0167919 A1 7/2007 Nemoto et al.
2008/0000699 A1 1/2008 Walker
2008/0058771 A1 3/2008 De Brabanter
2008/0195251 A1 8/2008 Milner
2008/0271928 A1 11/2008 Mehus et al.
2008/0283145 A1 11/2008 Maxwell
2009/0037026 A1 2/2009 Sostaric et al.
2009/0069934 A1 * 3/2009 Newman et al. ..... 700/239
2009/0090564 A1 4/2009 Kresina
2009/0126123 A1 5/2009 Kim et al.
2009/0134997 A1 5/2009 Godlewski
2009/0151474 A1 6/2009 Mehus et al.

(56) References Cited

U.S. PATENT DOCUMENTS

| | | | | |
|---|---|---|---|---|
| 2009/0171502 | A1 | 7/2009 | Freidin | |
| 2009/0294469 | A1 | 12/2009 | Poulain et al. | |
| 2010/0147876 | A1 | 6/2010 | Mehus et al. | |
| 2010/0163573 | A1 * | 7/2010 | Wegelin et al. | 222/1 |
| 2011/0077772 | A1 | 3/2011 | Buck et al. | |
| 2013/0001244 | A1 | 1/2013 | Wegelin et al. | |
| 2014/0017142 | A1 | 1/2014 | Mehus et al. | |

FOREIGN PATENT DOCUMENTS

| | | | |
|---|---|---|---|
| DE | 100 39 408 | A | 12/2001 |
| EP | 0917906 | A1 | 5/1999 |
| EP | 1671283 | A1 | 6/2006 |
| EP | 1671568 | A3 | 9/2006 |
| EP | 1579181 | B1 | 1/2007 |
| EP | 1890271 | A1 | 2/2008 |
| GB | 2 052 251 | | 1/1981 |
| GB | 2 120 563 | A | 12/1983 |
| GB | 2429694 | A | 3/2007 |
| GB | 2437276 | A | 10/2007 |
| JP | 359142832 | A | 8/1984 |
| JP | 360020122 | A | 2/1985 |
| JP | 360150823 | A | 8/1985 |
| JP | 361098657 | A | 6/1986 |
| JP | 362168529 | A | 7/1987 |
| JP | 36300143 | A | 1/1988 |
| JP | 401145525 | A | 6/1989 |
| JP | 401148916 | A | 6/1989 |
| JP | 401207124 | A | 8/1989 |
| JP | 404049110 | A | 2/1992 |
| JP | 6226068 | A | 8/1994 |
| JP | 4419415 | A1 | 12/1995 |
| JP | 09066995 | | 3/1997 |
| JP | 09066999 | | 3/1997 |
| JP | 11156101 | A | 6/1999 |
| WO | 9403097 | A1 | 2/1994 |
| WO | WO 98/26704 | A1 | 6/1998 |
| WO | WO 03/059143 | A1 | 7/2003 |
| WO | WO 2006/013362 | A1 | 2/2006 |
| WO | WO 2005/113420 | A3 | 6/2006 |
| WO | WO 2006/133026 | A2 | 12/2006 |
| WO | WO 2007/004162 | A1 | 1/2007 |

OTHER PUBLICATIONS

"Integrating RFID into manufacturing", http://www.foodprocessing.com/articles/2005/511.html, Oct. 10, 2005, (3 pgs.).
"RFID on the Production Line", Control Engineering, http://www.controleng.com/article/CA633172.html, Aug. 1, 2005, (7 pgs.).
"1756-EWEB Open socket interface", PLCS.net—Interactive Q & A, Nov. 25, 2005, (5 pgs.).
U.S. Appl. No. 12/331,060 entitled, "Authentication of Controlled Dosing Processes", filed Dec. 9, 2008.
The Notification of Transmittal of the International Searching Authority and the Written Opinion of the International Searching Authority, or the Declaration for counterpart application No. PCT/IB2010/054506, mailed Jul. 14, 2011, 10 pages.
Office Action from U.S. Appl. No. 11/799,692, dated Dec. 9, 2011, 8 pp.
Office Action from U.S. Appl. No. 12/130,541, dated Dec. 2, 2011, 9 pp.
Response to Office Action dated Dec. 2, 2011, from U.S. Appl. No. 12/130,541, filed Feb. 1, 2012, 13 pp.
Office Action from U.S. Appl. No. 12/331,060, dated Oct. 13, 2011, 12 pp.
Response to Office Action dated Oct. 13, 2011, from U.S. Appl. No. 12/331,060, filed Jan. 13, 2012, 10 pp.
Response to Office Action dated Dec. 9, 2011, from U.S. Appl. No. 11/799,692, filed Mar. 9, 2012, 6 pp.
CLAX Diverflow System, "Advanced Central Dosing Technology For Laundries," copyright DiverseyLever 1998, 3 pp.
Diversey, Diverlog-L Enhanced "DLE—Production Summary Reports," Apr. 1990, 5 pp.
Diversey, Diverlog-L Enhanced "DLE Set-up Report," Apr. 1990, 7 pp.
Diversey, Diverlog-L Enhanced "DLE—Single Cycle Reports," Mar. 1990, 5 pp.
ECOLAB® balancer.com, MRE, Jun. 4, 1997, 4 pp.
ECOLAB® Inc., product brochure: "relax. We've Got Your Pool Concerns Under Control," copyright 1998, 4 pp.
ECOLAB® Inc., product brochure: "We'd like to make a couple of things perfectly CLEAR," copyright 1998, 4 pp.
NexGen SI, Inc., "*InTouch* Water Treatment Information Management Solution," Mar. 29, 1999, 59 pp.
Nova Controls, Nova News, "Save Money and Gain Sales Features?" Aug. 12, 1992, 1 pp.
Nova Controls, "ORION Liquid Laundry Supply Dispenser," Feb. 1989, 5 pp.
NOVALINK™ Laundry Information System, ControlMaster Version 2.0 for Windows User's Guide, 2000, 39 pp.
NOVALINK™ brochure: "Laundry Information System: Overview Reports," Dec. 13, 1995, 6 pp.
NOVALINK™ OverView™ Program Pricing, undated, 1 pp.
PerSyst Inc., "Dial-A-Wash Automatic Laundry Room Attendant For Apartment And Complex Laundry Rooms," undated, 2 pp.
PerSyst Inc., "LDAS-2000 Remote Information Control and Management System for the Commercial Laundry And Vending Industry," undated, 4 pp.
PowerPoint Presentation: "ECOLAB® Aramark Uniform Services Joining Forces for Service Excellence," 1998, 69 pp.
Sample Reports, Nova Controls, Oct. 2, 1997, 8 pp.
Sample Reports, NOVALINK™ System, Jan. 22, 1996, 9 pp.
T-JET™ 2000 PC, "Wash-Aisle Productivity Manager Software Guide," ECOLAB® Textile Care Division, undated, 29 pp.

* cited by examiner

AUTOMATIC CALIBRATION OF CHEMICAL PRODUCT DISPENSE SYSTEMS

TECHNICAL FIELD

This disclosure relates to chemical product dispense systems.

BACKGROUND

A variety of automated chemical product dispensing systems that dispense chemical products are in use today. These chemical products come in a variety of forms, including, for example, fluids, solid product concentrates, powders, pellets, gels, extruded solids, etc. Automated chemical product dispensers are useful in many different chemical application systems, including cleaning systems relating to laundry operations, warewashing operations (e.g., a dishwasher), water treatment operations, and pool and spa maintenance, as well as other systems, such as food and beverage operations and agricultural operations. For example, chemical products used in a warewashing operation may include detergent, deionized water, sanitizers, stain removers, etc. Chemistry used in agriculture may include without limitation pesticides, herbicides, hydration agents and fertilizers. Other applications of the present invention may be used in, without limitation, dairies and dairy farms, (e.g., in teat dips); breweries; packing plants; pools spas, and other recreational water facilities; water treatment facilities, and cruise lines. Other chemical products may include without limitation glass cleaning chemicals, hard surface cleaners, antimicrobials, germicides, lubricants, water treatment chemicals, rust inhibitors, Automated chemical product dispensers can reduce labor and chemistry costs by automatically delivering predetermined amounts of chemicals in a proper sequence. Furthermore, some chemical products can be hazardous in concentrated form; therefore, automated chemical product dispensers reduce the risks of exposure to operators, who would otherwise measure and deliver the chemical products manually.

Conventional chemical product dispensing systems are typically programmed using various dispensing parameters designed to result in the dispensation of a predetermined amount of chemical product. An incorrect setting may result in either too much or not enough chemical product being dispensed. When insufficient chemical product is dispensed, the resulting use solution or other end use chemical product may be ineffective (such as in the case of laundry, warewashing, or other cleaning application). When too much of the chemical product is dispensed, waste of the chemical product and/or, in some cases, damage to the articles to which the chemical product is applied may occur. In addition, certain applications, such as sanitizing or disinfecting, must comply with Federal or State regulations mandating minimum/maximum concentration of chemical product. If the dispenser settings are incorrect, these regulations may not be satisfied.

SUMMARY

In general, this disclosure describes automatic calibration of a product dispense system, such as a chemical product dispense system. The automatic calibration occurs via electronic communication of product information. A chemical product includes an electronically readable tag or label that stores and communicates chemical product data concerning the chemical product. The chemical product data may include, for example, the name of the chemical product, the type or class of the chemical product, manufacturing information regarding the chemical product (e.g., manufacturing date, location, serial number, lot number, etc.), concentration of active ingredient(s) of the chemical product, a weight of the chemical product, a volume of the chemical product, a viscosity in the case of a liquid chemical product, a density of a chemical product, a hardness of a chemical product, a specific gravity of liquid chemical product, and/or other data concerning the chemical product. A chemical product dispenser includes an electronic label reader that reads the chemical product data from the electronically readable label. The chemical product dispenser also includes a controller that automatically calibrates dispensing parameters based on the chemical product data.

In one example, a method includes receiving, with a controller of a chemical product dispenser in which is loaded a chemical product to be dispensed, chemical product data from an electronically readable label associated with the chemical product, wherein the chemical product data includes a chemical product identifier and a current amount corresponding to an amount of chemical product remaining in the dispenser, and automatically calibrating, with the controller, at least one dispensing parameter based on the chemical product data.

In another example, an apparatus includes a chemical product dispenser that dispenses a chemical product based on at least one dispense parameter, a reader that receives chemical product data from an electronically readable label associated with the chemical product, the chemical product data including chemical product identifying information, and a controller that automatically calibrates the at least one dispense parameter based on the chemical product data.

The details of one or more examples are set forth in the accompanying drawings and the description below. Other features, objects, and advantages will be apparent from the description and drawings, and from the claims.

DETAILED DESCRIPTION

Figure 1:
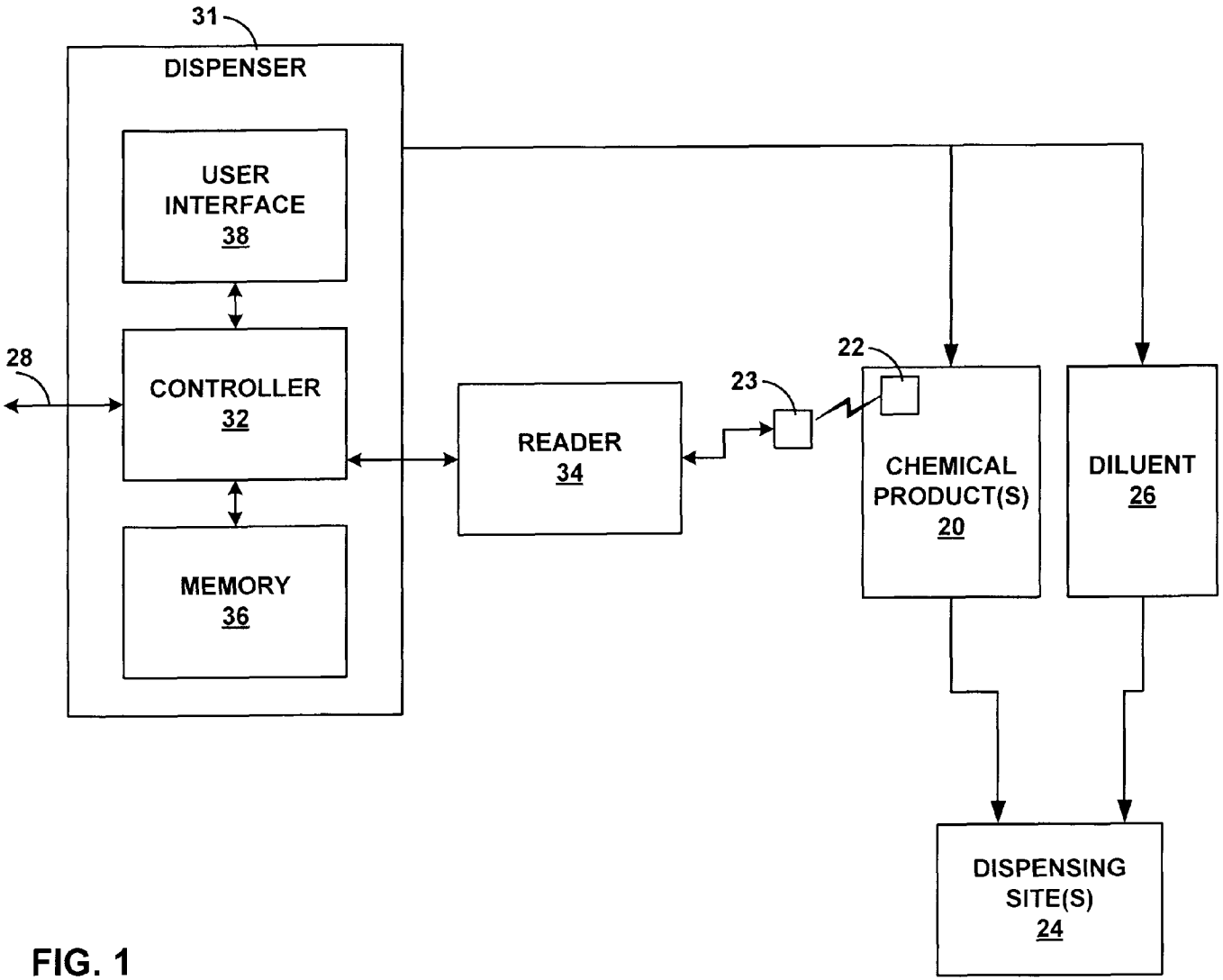
FIG. 1 is a block diagram illustrating an example chemical product dispense system that includes automatic calibration of dispensing parameters.

In general, this disclosure describes automatic calibration (also referred to herein as auto-calibration) of a product dispense system, such as a chemical product dispense system. The calibration occurs via electronic communication of product information. A chemical product includes an electronically readable tag or label that stores and communicates chemical product data concerning the chemical product. The chemical product data may include, for example, the name of the chemical product, the type or class of the chemical product, manufacturing information regarding the chemical product (e.g., manufacturing date, location, serial number, lot number, etc.), concentration of active ingredient(s) of the chemical product, a weight of the chemical product, a volume of the chemical product, a viscosity of a chemical product, a density of a chemical product, a hardness of a chemical product, a specific gravity of a chemical product, and/or other data concerning the chemical product. A chemical product dispenser includes an electronic label reader that reads the chemical product data from the electronically readable label. The chemical product dispenser also includes a controller that automatically calibrates dispensing parameters based on the chemical product data.

Auto-calibration of a chemical product dispensing system may help to account for variations that can arise during the process of manufacturing the chemical product, or from changes in the product dispensed over the course of its life cycle. For example, variations during the manufacturing process may result in variations in one or more chemical product parameters, such as the concentration of active ingredient(s), the weight, volume, density, hardness, specific gravity, viscosity, etc. Moreover, an individual chemical product dispenser may dispense a variety of chemical products throughout its lifetime. For example, the dispenser may be refilled using a different chemical product than was installed previously, the dispenser may be refilled with a chemical product having an updated formulation (e.g., new ingredients or different concentrations of existing ingredients), or the dispenser may be repurposed and therefore be required to dispense a different chemical product or different amount of chemical product.

The dispensing parameters may be dependent upon the type, form and chemical content of the chemical product being dispensed, and also upon the design of the chemical product dispenser itself. For example, the dispense system may be configured to dispense a predetermined volume, weight or mass of the chemical product; may be configured to dispense the chemical product for a predetermined amount of time; may be configured to dispense the chemical product until some other measurable threshold is satisfied (e.g., such as conductivity or pH of a resulting use solution), or may be configured according to any other relevant dispensing parameters. In addition, other dispensing parameters, such as the amount of diluent (e.g., water) is to be dispensed, may also be automatically calibrated based on the chemical product data.

FIG. 1 is a block diagram illustrating an example chemical product dispenser 31 that includes automatic calibration of dispensing parameters. In the example of FIG. 1, chemical product dispenser 31 dispenses one or more chemical product (s) 20 (only one of which is shown in FIG. 1) and/or a diluent 26 (e.g., water) to one or more dispensing sites 24. Dispensing site(s) 24 may include, for example, one or more container(s) (bucket, pail, tank, etc.), wash environment(s) (dishwasher, laundry machine, car wash environment, swimming pool, medical instrument sanitation apparatus, etc.), machinery (food or beverage processing equipment, manufacturing facility, etc.) or other environment in which the chemical product is to be used.

Dispenser 31, in this example, is a direct measurement dispensing system that aims to accurately control and measure the actual amount of chemical product dispensed. Direct measurement systems include weight-based dispensing systems, pellet counting, precise flow measurement using oval gears, flow meters and accurate stroke counting via diaphragm pumps.

Chemical product 20 includes an electronically readable label 22 that stores and communicates chemical product data that identifies and/or describes the chemical product. The chemical product data may include, for example, the name of the chemical product, the type or class of the chemical product (e.g., detergent, fabric softener, bleach, sanitizer, rinse agent, etc.), manufacturing information regarding the chemical product (e.g., manufacturing date, location, serial number, lot number, etc.), concentration of active ingredient(s) of the chemical product, a weight of the chemical product, a volume of the chemical product, a viscosity of a chemical product, a density of the chemical product, a hardness of a chemical product and/or a specific gravity of a chemical product, the shape or color of the chemical product, and/or other data concerning the chemical product.

In one example, electronically readable label 22 may include a radio frequency identification (RFID) tag. As another example, electronically readable label 22 may be implemented using bar codes, two-dimensional bar codes, a flash drive associated with product container 20, or other suitable electronically readable means for representing attributes of the product as are currently known or yet to be developed. It shall be understood, therefore, that any suitable electronically readable means for storing and/or communicating chemical product data may be used, and that the invention is not limited in this respect.

In the RFID example, label 22 may comprise an active, passive or semi-passive RFID tag and may operate at any appropriate frequency. The typical RFID tag includes an integrated circuit chip that stores the data and an antenna for receiving a radio frequency interrogation signal and for transmitting the data. RFID tags may be read-only, read/write or a combination. An active RFID chip generally includes a battery or other local power source. A passive RFID chip does not include a local power source, but is instead powered by an external RFID reader when the external RFID reader interacts with the chip. For example, a passive RFID chip is powered by an interrogation signal sent by an RFID reader and transmits, in return, an electromagnetic signal to the RFID reader that includes the data stored on the RFID chip. Similarly, an active RFID chip transmits data in response to an interrogation signal, but is not powered by the interrogation signal.

Some electronically readable labels, such as some RFID tags, are writable as well as readable. That is data may be written to and stored on the tag. For example, dispensing information may be written to the tag with each dispense cycle. Thus, the current amount of chemical product remaining in the dispenser, for example, may be written to the tag with each dispense cycle. Other types of electronically readable labels, such as bar codes and some RFID tags, are read-only, and thus a dispenser is able to read chemical product information from the label but may not write new information to the label.

Automatic calibration of dispenser 31 may be accomplished for a wide variety of chemical products, or other product to be dispensed. For example, chemical product 20 may be a fluid, a solid product concentrate, an extruded solid, a pressed solid, a powder, pellets, a gel, a paste, etc. The manner in which the chemical product is loaded into dispenser 31 may vary depending upon the form of the chemical product and/or the type of dispenser. For example, a product capsule (or other container) containing chemical product 20 may be loaded into dispenser 31, which then dispenses the chemical product from the product capsule. In that case, electronically readable label 22 may be affixed to the interior or exterior of the product capsule either independently or as part of the product packaging or labeling. Alternatively, the label 22 may be placed inside the container along with the chemical product without being affixed to the capsule. As another example, chemical product 20 may be loaded directly into dispenser 31, such as into a hopper, dish, tank, reservoir or other holder within dispenser 31 from which the product is dispensed. In that case, electronically readable label 22 may take the form of a water soluble bar code label adhered to the exterior of, for example, a pressed or extruded solid chemical product. Electronically readable label 22 may also take the form of a bar code printed in water soluble ink on the exterior of, for example, a pressed or extruded solid chemical product. Alternatively, a label 22 may be placed inside the product packaging so that when the chemical product is loaded into the dispenser, the label 22 is loaded along with it.

A reader 34 associated with dispenser 31 captures chemical product data from the electronically readable label 22 and passes the data to a programmable logic controller (PLC) 32 for processing. In the passive RFID example, reader 34 may be a radio frequency (RF) transmitter and receiver, controlled by a microprocessor or digital signal processor. Reader 34 includes an antenna 23 that generates RF interrogation signals that induce an electrical current in the RFID tag. In response to an interrogation signal, label 22 transmits its stored chemical product data to antenna 23, which is in turn received by reader 34 and then controller 32.

Dispenser 31 includes a controller 32 configured to control the overall operation of dispenser 31. For example, controller 32 is configured to automatically calibrate the dispensing parameters based on the chemical product data received from electronically readable label 22. Dispenser 31 also includes a user interface 138 that may include, for example, a display, a touch screen, a keyboard or keypad, a mouse, visible status indicators such as LEDs or other light, audible indicators such as speakers, alarms, buzzers, etc., and/or other type of user interface that allows a technician to view and receive status information concerning the dispenser 31 and/or control various aspects of dispenser 31. Dispenser 31 may also include communication links for wired or wireless networks, IR, WiFi, Bluetooth and/or other types of wired or wireless communication.

A memory 36 stores all necessary programming and data required for controller 32 to oversee operation of dispenser 31. For example, memory 36 may store system set up information, user configuration data, control algorithms, dispensing parameters, chemical product data, lookup tables, etc. The memory 36 may also store dispensing information such as the number of dispense cycles, the amount of chemical product dispensed per cycle, the current amount of chemical product remaining in the dispenser, etc.

Based on the received chemical product data, controller 32 automatically determines one or more dispense parameters and configures the dispenser using these dispense parameters so as to control the amount of chemical product dispensed. In this way, the dispenser is essentially customized to each individual chemical product at the time that the chemical product is loaded into the dispenser. For certain chemical products, the dispense parameters may also be automatically updated throughout the life cycle of the chemical product. Some of these parameters may include, for example, a target amount of product to be dispensed (as measured by weight, volume, or some other means of measuring), whether there is enough chemical product to satisfy the dispense request, a target concentration of active ingredient(s) in the resulting use solution, a target amount or volume of diluent (e.g., water) to be dispensed (such as to achieve a desired concentration of active ingredient(s) in the use solution), a predetermined period of time during which the chemical product should be sprayed with a diluent to achieve the desired concentration of chemical product in the use solution (in the case of a solid chemical product), a predetermined period of time during which a valve should remain open to dispense a liquid chemical product, flow meter "K" (correction) values that change depending upon the viscosity and/or density of the chemical product, or other dispense parameters corresponding to the type of chemical product to be dispensed and/or the dispenser itself.

Controller 32 may generally comprise any combination of hardware, software, and/or firmware to achieve the functionality attributed to controller 32. For example, controller 32 may comprise one or more processors, microprocessors, digital signal processors (DSPs), application specific integrated circuits (ASICs), field programmable gate arrays (FPGAs), or any other equivalent integrated or discrete logic circuitry, as well as any combinations of such components. Controller 32 may also comprise a computer-readable storage medium encoded with instructions to cause a programmable processor to perform the functions attributed to controller 32. In some examples, controller 32 may also receive instructions via a signal or carrier wave that controller 32 executes. For purposes of explanation, it is assumed that in the example of FIG. 1, controller 32 comprises a processor and a computer-readable storage medium encoded with instructions for causing the processor to perform the functions attributed to controller 32. In some examples, controller 32 may comprise a complete computing device communicatively coupled to dispensing system 30.

In some examples, product dispense system 30 may present a user interface by which a user may send a signal to controller 32 to indicate that a chemical product 20 has been loaded into dispenser 31 and is available to be read by reader 34. The user interface may also allow the user to begin use of product dispense system 30, e.g., to start a washing apparatus or other end process at the dispensing site 24. In other examples, controller 32 may periodically (e.g., every thirty seconds) cause reader 34 to issue an interrogation signal to determine whether a tag, such as label 22, is available to be read and, upon determining that a label 22 is available, to automatically read data from label 22.

Upon retrieving data from label 22 via reader 34, controller 32 may automatically determine the appropriate dispense parameters with which to configure the dispenser to result in dispensation of the proper amount (within a reasonable margin of error) of chemical product. Throughout its lifetime, an individual dispenser may dispense a variety of different products, including different types of chemical products, chemical products having different concentrations or combinations of active ingredient(s), chemical products having different target end use concentrations of the chemical product or the active ingredient(s), chemical products having different weights, densities or specific gravities, etc. Also, within a particular product line, variations in the manufacturing process may result in variations among products of the same product line, such as variations in concentration of active ingredient(s), weight of the chemical product, viscosity, density etc. Each of these variations may require variations in the target amount of chemical product to be dispensed and/or corresponding variations in the dispense parameters that will achieve dispensation of the target amount within a desired degree of accuracy.

As an example, for a relatively less concentrated product, the target amount of chemical product to be dispensed may be higher (relative to the amount of diluent) as compared to a relatively higher concentrated product having the same active ingredient(s). This change in target amount to be dispensed may result in a corresponding change in the dispense parameters. For example, the time during which a solid concentrate is sprayed with a diluent may be higher for the relatively less concentrated product; or, the time that a valve is opened to dispense a fluid chemical product may be longer for the relatively less concentrated product, etc.

As another example, the viscosity or density of a liquid chemical product may change from batch to batch. The viscosity or density of the liquid chemical product, determined at the time of manufacture, may be stored as part of the chemical product data in the electronically readable label. Once the chemical product data is obtained, the controller may automatically adjust certain dispense parameters, such as the K value (correction value), for a flow meter that measures the amount of liquid chemical product dispensed. This may result in more accurate dispensation of liquid chemical products as the flow meter may essentially be customized to each container of liquid chemical product.

In addition, changes in an individual chemical product also occur over the course of its lifetime in a dispenser. For example, the weight of the chemical product will be reduced during each dispensing cycle. Such changes may affect the ultimate determination of the dispense parameters. For example, for solid chemical products, the relative amount of product dispensed by dissolving versus eroding may change as more of the product is dispensed and less of the product remains in the dispenser. In addition, some products may begin to slough excess chemical product or be affected by higher degrees of water absorption throughout their lifetime. The dispenser may, at various times throughout the product life cycle, change the dispense parameters to account for such changes.

Automatic determination of dispense parameters based on chemical product information retrieved from the electronically readable labels 22 may also permit the dispenser to adjust to one or more variables. For example, if both viscosity and density change for a liquid chemical product, the dispense parameters may be adjusted accordingly. Thus, controller is able to automatically adjust the dispense parameters based on multiple chemical product attributes.

After controller 32 determines the dispense parameters, controller 32 controls dispensation of the chemical product and/or the diluent based on the dispense parameters. For example, controller 32 may control opening/closing of a valve that controls flow of diluent 26 to dispensing site 24 based on the dispense parameters such that a desired amount of diluent is dispensed. Similarly, if chemical product 20 is a liquid, controller 32 may control opening/closing of a valve that controls flow of the liquid chemical product to dispensing site 24 based on the dispense parameters such that a desired amount of chemical product is dispensed. Controller 32 may likewise control dispenser 30 to dispense the desired amount of chemical product by controlling the relevant dispense parameters when the chemical product is a gel, solid, pellets, powder, concentrate or other form of chemical product.

In some examples, controller 32 may automatically update the chemical product data stored in label 22 to reflect that chemical product has been dispensed. For example, after each dispensing cycle, controller 32 may update the weight and/or volume information stored by label 22 so that label 22 stores the current amount of chemical product remaining in the dispenser. Alternatively, controller 32 may continuously update the weight and/or volume information.

As another example, controller 32 may perform a threshold evaluation before dispensing any chemical product. For example, controller 32 may compare the current amount of chemical product remaining with an out-of-product threshold. If the current amount remaining is less than the out-of-product threshold, controller 32 may prevent dispensation of chemical product if there is insufficient chemical product to satisfy the dispense request. Controller 32 may also generate an out-of-product message. The out-of-product message may be a visual out-of-product message presented via user interface 38 and/or an audible alarm or alert. The out-of-product message may also be an electronic communication such as e-mail, text message, voice message, etc. communicated to a service technician or management center via a communication link 28. Communication link 28 may allow dispenser 30 to connect to a local area network (LAN), wide area network WAN), telephone network, mobile/cell phone network, satellite network, the internet, etc.

Alternatively or in addition, controller 32 may evaluate other parameters, such as a chemical product reorder threshold (e.g., a threshold at which additional chemical product should be ordered) and generate a corresponding reorder message or automatically order additional product; calculate an estimated time to refill and generate a corresponding estimated time to refill message; etc.

In addition to automatically calibration of dispenser 31, the chemical product data stored on label 22 may be used in other ways. For example, the data may be used in a closed loop system internally to a business or enterprise to perform asset tracking, inventory ordering, production planning and quality control. The data may also be used in an open loop system with suppliers to record and monitor quality and inventory, as well as to offer customers services such as automatic billing, automatic ordering, automatic inventory control, and automatic delivery. The data may further be used to modify a billing system, e.g., to bill customers by a number of doses of the chemical product used over a given time period.

Figure 2:
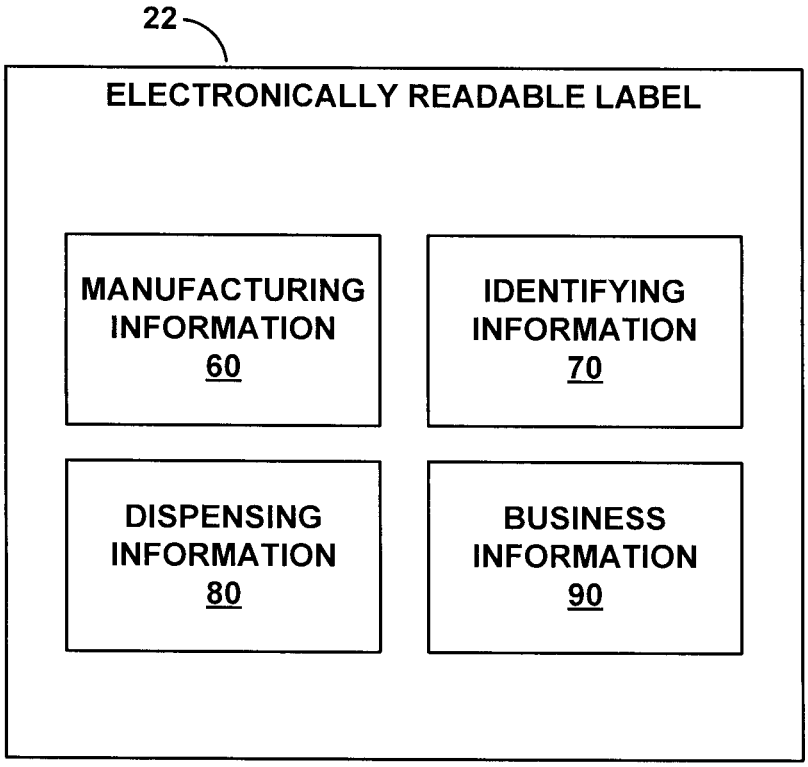
FIG. 2 is a block diagram illustrating an example of chemical product data stored by an electronically readable label.

FIG. 2 is a block diagram illustrating example chemical product data stored by electronically readable label 22. In the example of FIG. 2, label 22 includes manufacturing information 60, identifying information 70, dispensing information 80 and business information 90. Manufacturing information 60 may include, for example, data concerning the manufacture of the chemical product, such a serial number, a pick code, a lot code, employee shift information, information as to where and when product container 20 was filled, information as to when and where the product was manufactured, the weight of the chemical product container, if any, or other such information. In some examples, filling date 66 may be used (either by controller 32 in dispenser 31, by a local computer or central server) to estimate an expiration date for the contents of product container 20. It should be understood that in other examples, additional manufacturing information may be included, alternative manufacturing information may be included or a subset of the manufacturing information presented in the example of FIG. 2 may be included. In some examples, label 22 may contain no manufacturing information 60, only identifying information 80. In some examples, manufacturing information 60 may additionally include manufacturing quality assurance values and a product line to which the contents of product container 20 correspond.

Identifying information 80 may include, for example, an identifier of the chemical product, such as a product name or stock-keeping unit (SKU), a quantity value such as the weight and/or volume at the time of manufacture, the current weight of chemical product remaining in the container, and chemical properties of the product such as viscosity, specific gravity, density, hardness, concentration of active ingredient(s), etc. It shall be understood that in other examples additional identifying information may be included, alternative identifying information may be included, or a subset of the identifying information presented in the example of FIG. 2 may be included. The identifying information may depend at least in part upon the particular chemical product at issue and the relevant identifying information and chemical properties associated with the chemical product.

For example, when the contents of product container 20 comprise a solid product, identifying information 80 may not include viscosity or specific gravity information. In addition, in some examples, identifying information 70 may includes a package weight value that represents the weight of product container 20 alone, without the weight of the contents of product container 20. This may be used to calibrate the dispenser so that the amount of chemical product may be determined by subtracting the weight of the container from the total measured weight of the chemical product and the container for certain types of dispensers.

As another example, the identifying information may also include information concerning variance of chemical properties with temperature. For example, the viscosity of liquid chemical products may vary with temperature. The viscosity of caustic products, for example, may vary widely with temperature, and this variation may be significant enough to affect the accuracy of the amount dispensed. Thus, identifying information 70 may include a lookup table of viscosity of the chemical product at various temperatures. The dispenser controller may determine the current viscosity of the chemical product by looking up the viscosity that corresponds to a temperature received, for example, from an external (environmental) temperature sensor, and thus be able to adjust the dispense parameters to account for any variations in ambient temperature.

Dispensing information 80 may include, for example, information that is updated with each dispensing cycle, such as the current amount of chemical product remaining in the dispenser (e.g., volume or weight), the amount of chemical product dispensed during each dispensing cycle, the total number of dispenses for this particular chemical product, etc. It shall be understood that in other examples additional dispensing information may be included, alternative dispensing information may be included, or a subset of the dispensing information presented in the example of FIG. 2 may be included. The dispensing information may depend at least in part upon the type of chemical product and the type of chemical product dispenser and the parameters associated with the chemical product dispenser.

Business information 90 may include, for example, information concerning business arrangements for certain chemical products, such as discounts for identified corporations or accounts, quantity discounts, whether the chemical product is approved for use/purchase by certain accounts, etc. It shall be understood that in other examples additional business information may be included, alternative business information may be included, or a subset of the business information presented in the example of FIG. 2 may be included.

It shall be understood that although example chemical product is described herein, other relevant chemical product data may be substituted for or provided in addition to the chemical product data described herein, and that the invention is not limited in this respect.

At least some of the chemical product information stored on electronically readable label 22 may be determined by certified instrumentation at the point of manufacture. For example, the weight of the empty chemical product container, as well as the weight of the product container when filled with chemical product, as well as any other relevant quantifiable measurements, may be determined by certified weighing instrumentation at or near the time of manufacture. The certified chemical product information would then be stored on the electronically readable label 22. This information would be determined for each empty product container and each filled product container. Similarly, other quantifiable chemical properties, such as concentration of active ingredient(s), weight, volume, density, viscosity, hardness of a chemical product, a specific gravity, etc. would also be determined using certified instrumentation. In this way, the actual values for each of these parameters would be accurately measured and recorded on the electronically readable label associated with each individual chemical product. This process helps to ensure accurate dispensing because dispense parameters are automatically calibrated for each individual chemical product.

In another example, at least some of the chemical product information may be determined by an on-site formulation system and written to a writable electronically readable label. In this example, reusable containers may be fitted with writable electronically readable labels. The on-site formulation system is designed to fill/refill reusable containers with a selected chemical product. The formulation system may include instrumentation (such as by weighing, etc.) to determine whether the container is empty, full or partially full. The formulator may also read the chemical product information from the label to identify the chemical product in the container. In this way the formulator would know the identity of and the amount of chemical product currently in the container, if any, and may then determine how much of the identified chemical product should be added to fill/refill the reusable container. The formulator may then write the chemical product information corresponding to the fill/refill, such as chemical product identification, date and time of refill, amount of chemical product added to the container, the total amount of chemical product in the container, chemical properties such as density, viscosity, specific gravity, concentration, hardness, etc. to the electronically readable label. The chemical product information on the reusable container would then be read by a dispenser which dispenses the chemical product from the reusable container to a dispensing site, and the dispenser automatically determines the dispense parameters based on the chemical product information.

Figure 3:
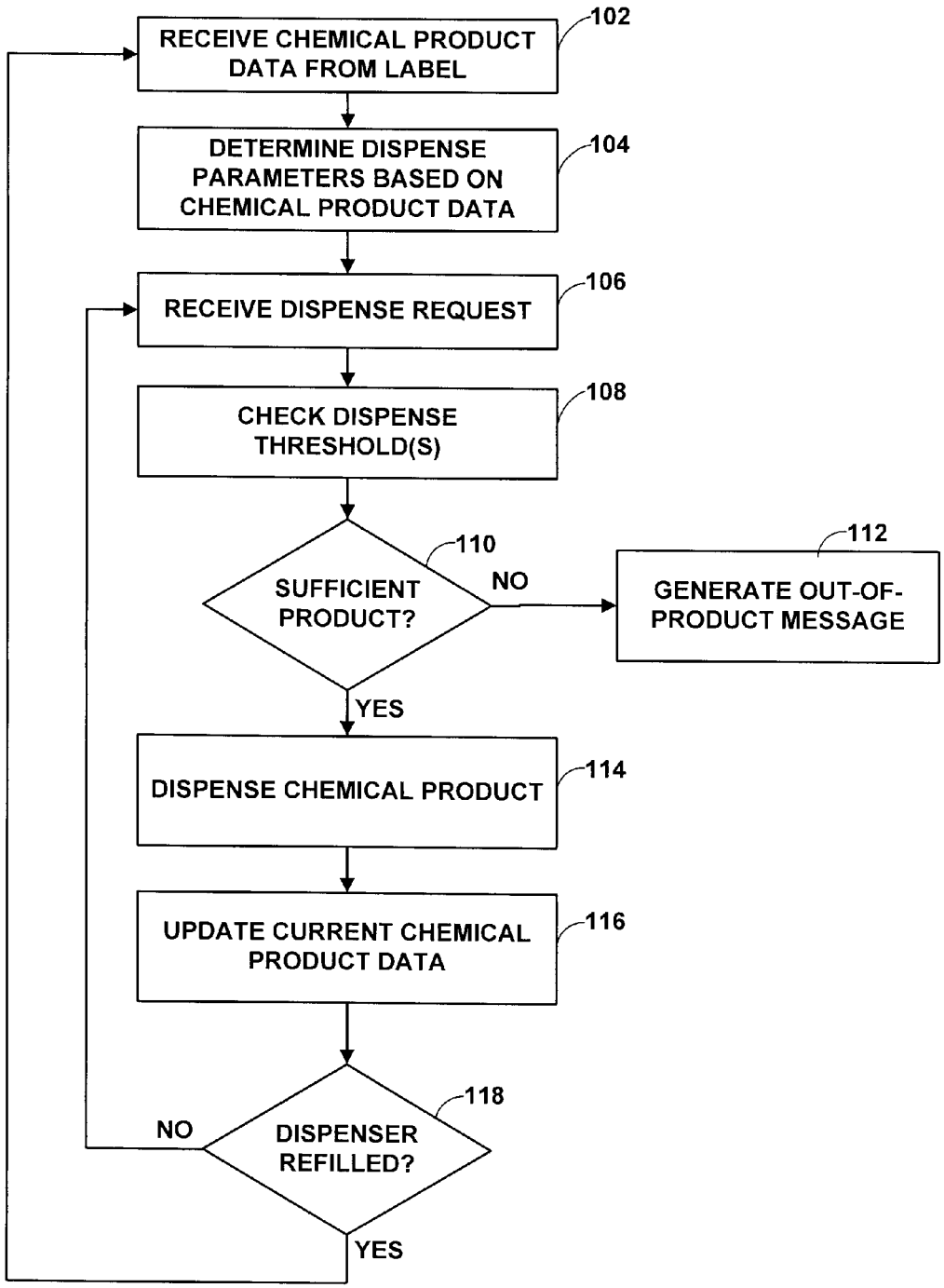
FIG. 3 is a flowchart illustrating an example process by which controller 32 uses chemical product data stored on an electronically readable label to automatically calibrate a product dispense system.

FIG. 3 is a flowchart illustrating an example process by which controller 32 uses chemical product data stored on label 22 to automatically calibrate a product dispense system. Controller 32 receives chemical product data from label 22 (102). For example, an RFID reader 34 may wirelessly read the chemical product data from label 22 and send the data to controller 32. Controller 32 automatically determines the dispense parameters based on the chemical product data obtained from the label 22 (104).

At this time controller 32 may also check whether the chemical product has been identified as a bad or out-of-spec batch. This information may be received, for example, remotely from a server computer or downloaded either remotely or directly from a service technician. If the chemical product is determined to be a bad batch, controller 32 may generate a corresponding message and refuse to dispense the product, or controller 32 may automatically determine dispense parameters designed to compensate for the bad batch and proceed with executing the dispense request When controller 32 receives a dispense request (106), controller 32 may evaluate certain of the dispense thresholds (108). For example, controller 32 may evaluate the out-of-product threshold to determine, whether there is any chemical product remaining and/or whether or not there is sufficient chemical product remaining to satisfy the dispense request. If there is not sufficient chemical product remaining to satisfy the dispense request (110), controller 32 may generate an out-of-product message (112). As discussed above, the out-of-product message may be a visual or audible alert presented via user interface 38, or may be an electronic communication such as an e-mail, text message, voice mail message, page, etc. Similarly, controller 32 may evaluate the low product threshold to determine whether the product is approaching empty, and may generate a corresponding low product message (not shown).

If there is sufficient chemical product remaining to satisfy the dispense request (110), controller 32 may control dispenser 31 to dispense the appropriate amount of chemical product in accordance with the determined dispense parameters (114). After the chemical product has been dispensed, controller 32 may update the chemical product data stored on label 22 (if it is a writable label) concerning the current amount of chemical product remaining, the total number of dispenses, etc. and/or other updated information concerning the chemical product that reflects that chemical product has been dispensed (116). Controller 32 may also store some, all or different chemical product data in dispenser memory 36 (116). In the event that label 22 is a bar code or other read-only label, the dispenser may update the chemical product data and store the data in dispenser memory 36 (116).

Each time dispenser 31 is refilled, controller 32 receives a signal indicative of a dispenser refill. If the dispenser has not been refilled (118), controller 32 waits to receive the next dispense request (106) and then dispenses the chemical product according to the previously determined dispense parameters (108-116). If the dispenser has been refilled (118), controller 32 receives the chemical product data from the label 22 associated with the newly installed chemical product (102) and determines the dispense parameters based on the chemical product data for the newly installed chemical product (104).

Figure 4:
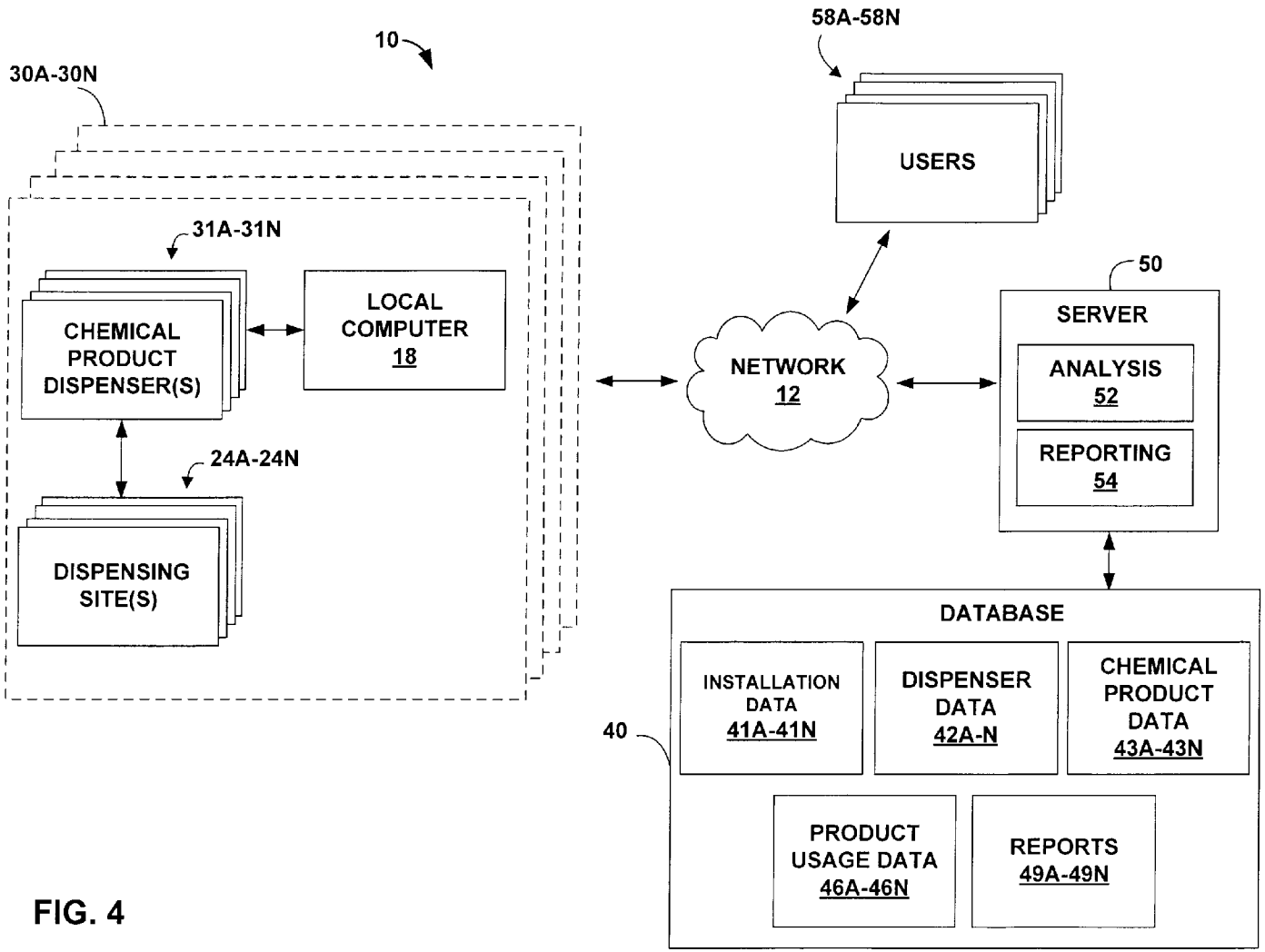
FIG. 4 is a block diagram illustrating another example chemical product dispense system that includes automatic calibration of dispensing parameters.

FIG. 4 is a block diagram illustrating another example chemical product dispense system that includes automatic calibration of dispensing parameters. System 10 includes one or more chemical dispensing installations 30A-30N, each of which may include one or more chemical product dispensers 31A-31N that dispense one or more chemical products to one or more dispensing sites 24A-24N. Chemical dispensing installations 30A-30N may be, for example, laundry facilities, hotels, restaurants, food service facilities, medical facility, food and beverage operation, agricultural operation, or any other operation or installation in which chemical products are dispensed.

One or more dispensing installations 30A-30N are coupled via network(s) 12 to a server computer 50. Network(s) 12 may include, for example, one or more of a dial-up connection, a local area network (LAN), a wide area network (WAN), the internet, a cell phone network, satellite communication, or other means of electronic communication. The communication may be wired or wireless.

Server computer 50 may be coupled to a local server computer 18 at each dispensing installation 30A-30N via network (s) 12 to receive chemical product data that is gathered and stored on local storage media at each dispensing installation. Server computer 50 may also send commands, instructions, software updates, or other communications, etc. to each dispensing installation 30A-30N via network(s) 12. Server computer 50 may receive data or otherwise communicate with the dispensing installations on a periodic basis, in real-time, upon request of server computer 50, or at any other appropriate time. These communications may relate to an individual installation, multiple installations, or to one or more dispensers at the sites. The communications may include, for example, formula updates, calibration commands, test commands, alarm commands, interactive communications between a site manager or service technician and the dispenser vendor or server computer facility, and other remote control commands. This capability facilitates the management of multiple, geographically dispersed sites by allowing facility managers, operators, service technicians, dispenser vendors or other users to distribute control commands from a central location via the communications network 12. An example involves updating a chemical product dispense formula/parameters stored in the storage medium of a dispenser based on analysis of chemical product data by the server computer 50.

The chemical product data received from dispensing installations 30A-30N, as well as other data associated with the operation of the dispensing installations, may be stored on a database 40. Database 40 may store, for example, installation data 41A-41N associated with each of the dispensing installations 30A-30N, respectively; dispenser data 42A-42N associated with each of the dispensing installations 30A-30N, respectively; chemical product data 43A-43N associated with each of the dispensing installations 30A-30N, respectively; product usage data 46A-46N associated with each of the dispensing installations 30A-30N, respectively; and reports 49A-49N associated with each of the dispensing installations 30A-30N, respectively.

Installation data 41A-41N may include data that uniquely identifies or is associated with the respective chemical dispensing installation 30A-30N. As such, installation data 41A-41N may include, for example, dispensing installation identification information, employee information, management information, accounting information, business information, pricing information, information concerning those persons or entities authorized to access reports, date and time stamps, and additional information relating to other aspects of the corporation or operation and other information specific to each individual dispensing installation 30A-30N. Installation data may also include installation or corporate-wide performance targets, site-specific performance targets customized to a particular installation(s), or dispenser-specific performance targets customized to a particular dispenser at a particular dispensing installation. These corporate-, installation- or dispenser-specific performance targets may include targets specifying the amount of each chemical product that should be dispensed per unit time, chemical cost targets, utility cost targets, etc. Installation data 41A-41N may be stored and analyzed alone or in combination with dispenser data 42A-42N and/or chemical product data 43A-43N, or with other data as described herein.

Dispenser data 42A-42N may include, for example, any information associated with operation of the chemical product dispensers in the respective installation 30A-30N. For example, dispenser data 42A-42N may include, without limitation, one or more of the following data types: dispenser id; dispenser type; dispensed product name; dispensed product type (e.g., sanitizer, soap, alcohol, etc.); dispensed product form (solid, liquid, gel, powder, pelleted, etc.); dispensed product amounts (by volume, weight, or other measure); dispensing times, dates, and sequences; detected employee ids linked to specific dispensing events; empty, out-of-product or low product dispenser indications; and other information originating at the dispensing installation site, whether detected by a dispenser or by an associated device. In the case of a dispenser that mixes a chemical product with a diluent, dispenser data may include information regarding the amount of chemical product dispensed, the amount of diluent added, and/or the final concentration of active ingredient(s) in the resulting dispensed product or use solution. Dispenser data may also include information concerning the dispenser itself such as dispenser id, date/time of dispensing, employee id, dispenser error information, utility (e.g., electric, gas or water) usage, total dispensing time, total operating time, dispenser performance information, product empty indications, water flow volumes, and other information originating at the dispenser, whether detected by a dispenser or by an associated device (such as a remote temperature probe, concentration monitor, etc.).

Dispenser data 42A-42N may also include calibration parameters that control the amount of chemical product or diluent dispensed, dispensing formulas that control times, amounts and sequences of chemical products dispensed for a particular machine or cycle of a machine, etc. These calibration parameters may be automatically updated based on chemical product data received from electronically readable labels as described herein. In this way, server computer 50 is made aware of any changes in dispensing parameters made by the dispensers 31A-31N based on the chemical product information received from electronically readable labels. Receipt and/or storage of the dispenser calibration parameters may permit analysis of these parameters to be performed by an analysis application and generation of corresponding reports so that dispenser calibration parameters may be compared on a dispenser by dispenser basis to check for errors or increase efficiency, etc.

Chemical product data 43A-43N includes the data read from each of electronically readable labels 22 from the chemical products loaded into each dispenser 31A-31N at each of the dispensing installations 30A-30N. The chemical product data 43A-43N would be associated with the relevant dispenser data 42A-42N so that server computer 50 may associated chemical product data from each label 22 with a particular dispenser 31. As described above, chemical product data 43A-43N may include, for example, manufacturing information, identifying information, dispensing information and/or business information. As such, the chemical product data may include the name of the chemical product, the type or class of the chemical product (e.g., detergent, fabric softener, bleach, sanitizer, rinse agent, etc.), manufacturing information regarding the chemical product (e.g., manufacturing date, location, serial number, lot number, etc.), concentration of active ingredient(s) of the chemical product, a weight of the chemical product, a volume of the chemical product, a density of the chemical product, a viscosity of a chemical product, a hardness of a chemical product, a specific gravity of a chemical product, and/or other relevant data concerning the chemical product.

Server computer 50 includes an analysis application 52 that analyzes the chemical product data and/or other data received from each of installations 30A-30N and stores the results for each installation 30A-30N in the database 40. Analysis application 52 may analyze the installation data 41A-41N, dispenser data 42A-42N, chemical product data 43A-43N either alone or in various combinations with each other to monitor operation and performance of the dispenser (s) 31A-31N at each dispensing installation 30A-30N by individual dispenser, by type of dispenser, by type of chemical product dispensed, by individual installation, by some combination or group of installations, by type of installation, across multiple installations, or by various other selected parameters.

A reporting application 54 generates a variety of reports that present the analyzed data. Reporting application 54 may generate a variety of reports to provide users local to each installation 30A-30N or remote users 58 with both qualitative and quantitative data regarding chemical product dispenser performance at their particular installation or installations, and/or to compare data over time to determine whether improvement has occurred. Reporting application 54 may also allow users to benchmark dispenser/installation performance at multiple installations. Reporting application 54 may also allow users to create customized reports of the data.

Reports 49A-49N associated with each installation 30A-30N, respectively, may also be stored in database 40. Reports 49A-49N may be accessed by various authorized users local to each installation 30A-30N or by authorized remote users 58 over one or more network(s) 12. One or more of the reports 49A-49N may be downloaded and stored on a local hospital computer 18, or to a user computer, laptop, PDA, cell phone, other authorized computing device, printed out in hard copy or further communicated to others as desired.

Remote users 58 may include facility managers, operators, service technicians, dispenser vendors, corporate managers or executives or other users to whom the information presented in reports 49A-49N may be valuable in helping to plan or run the installation or business with which they are associated.

Reports 49A-49N may include, for example, corporate summary or historical reports, installation summary or historical reports, dispenser summary or historical reports, chemical product dispensing summaries or historical reports, benchmarking of multiple installations or dispensers, etc. Summary and historical reports may be available on a installation-by-installation basis, allowing the user a means of tracking dispensing of chemical products, errors and cost issues for an individual dispensing installation. Corporate summary, spanning multiple installations corresponding to a single alignment (where alignments are based on groupings of dispensers or installations that may be relevant to a particular corporation, such as all hotel sites within a corporation that also includes restaurant and retail sites), all liquid cleaner dispensers, all sites using a particular chemical product, etc.) or corporation may be useful in identifying trends and corporate-wide chemical dispense problems. Accordingly, a business entity can effectively manage its chemical product dispense operations on an individual dispenser basis, an individual installation basis, a multiple installation basis and/or a corporate-wide basis to manage chemical costs and improve chemical product dispensing efficiency. Such information, for example, may be useful in developing training programs for employees, negotiating agreements, increasing installation efficiency and effectiveness, reducing costs and/or coordinating scheduled maintenance throughout a corporation's multiple sites. The data may also be used in a closed loop system to offer customers services like automatic billing, automatic ordering, automatic inventory control, and/or automatic delivery, be it by container or by dose per a given time period. Also data can be utilized internally for asset tracking, inventory ordering, production planning, and quality control. The reports may allow accounts to be monitored for inventory usage.

Local computer 18 or an associated database may also store the above-described data (e.g., installation data, dispenser data, chemical product data, etc.) associated with that installation. Local computer 18 or associated database may also include local analysis and reporting applications such as those described above with respect to analysis and reporting applications 52 and 54. In that case, reports associated with that particular installation may be generated and viewed locally, if desired. In another embodiment, all analysis and reporting functions are carried out remotely at server computer 50, and reports may be viewed, downloaded or otherwise obtained remotely. In other embodiments, some installations 30A-30N may include local storage and/or analysis and reporting functions while other installations 30A-30N rely on remote storage and/or analysis and reporting. Thus, although the general case of data being stored at the local computer 18 and analysis/reporting being carried out by the server computer 50 is described herein, it shall be understood that these storage, analysis and reporting functions may also be carried out locally or at some other location, and that the invention is not limited in this respect.

Product usage data 46A-46N is generated by analysis application and may include information that is a combination of dispenser data 42, chemical product data 43 and/or installation data 41. One example of product usage data 46 would be a comparison between the total dispensed amount of a particular chemical product per unit time and a target dispensed amount for that chemical product per unit time. Other examples of product usage data may include comparisons of other types of dispenser data or chemical product data to relevant corporate, installation-specific or dispenser-specific targets, totalized or benchmarked dispenser data, labor usage information, utility usage information, chemical costs, utility costs, labor costs, procedural error information and performance information. The product usage data may be generated on a dispenser, installation, alignment (any user-defined group or installations having a desired parameter in common, such as an alignment based on installation type (laundry, hotel, restaurant, etc.); type of chemical product dispensed; corporate subdivision (e.g., certain group of restaurants or other facilities owned by a parent corporation) or corporate level. The product usage data may also be generated based on chemical product, employee, service provider, etc., or by any other parameter by which the dispenser and corporate data may be analyzed. For example, dispenser data 42A-42N may include the total number of dispenses for each type of chemical product dispensed at each dispensing installation 30A-30N along with the total amount of chemical product dispensed. Product usage data may also include the cost per dispense and the total cost of chemical product used for each dispenser, each installation or across multiple installations, and comparisons between such costs on a per dispenser, per installation, alignment, or other basis. The product usage data generated by analysis application and the reports generated therefrom may help to illustrate trends for the customer, conveying how much chemical product is used and when so that errors may be noted and rectified, and efficiency and/or efficacy may be increased.

The techniques described in this disclosure may be implemented, at least in part, in hardware, software, firmware or any combination thereof. For example, various aspects of the described techniques may be implemented within one or more processors, including one or more microprocessors, digital signal processors (DSPs), application specific integrated circuits (ASICs), field programmable gate arrays (FPGAs), or any other equivalent integrated or discrete logic circuitry, as well as any combinations of such components. The term "processor" or "processing circuitry" may generally refer to any of the foregoing logic circuitry, alone or in combination with other logic circuitry, or any other equivalent circuitry. A controller comprising hardware may also perform one or more of the techniques of this disclosure.

Such hardware, software and firmware may be implemented within the same device or within separate devices to support the various operations and functions described in this disclosure. In addition, any of the described units, modules or components may be implemented together or separately as discrete but interoperable logic devices. Depiction of different features as modules or units is intended to highlight different functional aspects and does not necessarily imply that such modules or units must be realized by separate hardware or software components. Rather, functionality associated with one or more modules or units may be performed by separate hardware or software components, or integrated within common or separate hardware or software components.

The techniques described in this disclosure may also be embodied or encoded in a computer-readable medium, such as a computer-readable storage medium, containing instructions. Instructions embedded or encoded in a computer-readable medium may cause a programmable processor, or other processor, to perform the method, e.g., when the instructions are executed. Computer readable storage media may include random access memory (RAM), read only memory (ROM), programmable read only memory (PROM), erasable programmable read only memory (EPROM), electronically erasable programmable read only memory (EEPROM), flash memory, a hard disk, a CD-ROM, a floppy disk, a cassette, magnetic media, optical media, or other computer readable media.

Various examples have been described. These and other examples are within the scope of the following claims.

The invention claimed is:

1. A method comprising:

receiving, with a controller of a chemical product dispenser in which is loaded a chemical product to be dispensed, chemical product data from an electronically readable label associated with the chemical product, wherein the chemical product data includes a chemical product identifier and a current amount corresponding to an amount of the chemical product remaining in the dispenser;

automatically calibrating, with the controller, dispensing parameters based on the chemical product data, wherein the dispensing parameters include a dispensing parameter indicative of an amount of the chemical product to be dispensed and a dispensing parameter indicative of an amount of a diluent to be dispensed;

dispensing, with the chemical product dispenser, the chemical product and the diluent during a dispensing cycle based on the automatically calibrated dispensing parameters;

determining, with the controller, the current amount of the chemical product remaining in the dispenser after completion of the dispensing cycle;

determining, with the controller, an actual amount of the chemical product dispensed during the dispensing cycle;

updating, with the controller, the chemical product data stored on the electronically readable label, including the actual amount of the chemical product dispensed during the dispensing cycle and the current amount of chemical product remaining in the dispenser after completion of the dispensing cycle; and automatically updating, with the controller and after at least one dispensing cycle, the dispensing parameter indicative of the amount of the chemical product to be dispensed and the dispensing parameter indicative of the amount of diluent to be dispensed based on the current amount of chemical product remaining in the dispenser.

2. The method of claim 1, wherein the chemical product data further includes a concentration of at least one active ingredient in the chemical product.

3. The method of claim 1, wherein the chemical product data further comprises a chemical property of the chemical product.

4. The method of claim 3, wherein the chemical property comprises at least one of a viscosity, a density, a hardness and a specific gravity of the chemical product.

5. The method of claim 3, wherein automatically calibrating the dispense parameters further comprises automatically calibrating the dispense parameters based on the chemical property.

6. The method of claim 1, wherein automatically calibrating the dispense parameters comprises calculating the amount of the chemical product to be dispensed based on the chemical product data.

7. The method of claim 1, wherein automatically calibrating the dispense parameters comprises calculating an amount of time to spray a solid chemical product with the diluent based on the chemical product data.

8. The method of claim 1, wherein dispensing chemical product comprises dispensing the chemical product to one of a bucket, pail, tank, wash environment, dishwasher, laundry machine, car wash environment, swimming pool, medical instrument sanitation apparatus, food processing equipment, beverage processing equipment, or manufacturing facility.

9. The method of claim 1, further comprising comparing the current amount of the chemical product remaining with at least one of a reorder-product threshold, a low-product threshold and an out-of-product threshold.

10. The method of claim 9, further comprising automatically ordering, with the controller, additional chemical product when the amount of the chemical product remaining satisfies the reorder-product threshold.

11. The method of claim 9, further comprising automatically generating, with the controller, a low-product alert when the amount of the chemical product remaining satisfies the low-product threshold.

12. The method of claim 9, further comprising automatically generating, with the controller, an out-of-product alert when the amount of the chemical product remaining satisfies the out-of-product threshold.

13. An apparatus, comprising:

a chemical product dispenser that dispenses a chemical product during a dispense cycle based on at least one dispense parameter, and that measures an amount of chemical product remaining in the dispenser;

a reader that receives chemical product data from an electronically readable label associated with the chemical product, the chemical product data including chemical product identifying information; and a controller that automatically calibrates dispensing parameters based on the chemical product data, wherein the dispensing parameters include a dispensing parameter indicative of an amount of the chemical product to be dispensed and a dispensing parameter indicative of an amount of a diluent to be dispensed, determines a current amount of the chemical product remaining in the dispenser after completion of the dispense cycle, determines an actual amount of the chemical product dispensed during the dispensing cycle, updates the chemical product data stored on the electronically readable label, including the actual amount of the chemical product dispensed during the dispensing cycle and the current amount of chemical product remaining in the dispenser after completion of the dispensing cycle, and automatically updates, after at least one dispensing cycle, the dispensing parameter indicative of the amount of the chemical product to be dispensed and the dispensing parameter indicative of the amount of diluent to be dispensed based on the current amount of chemical product remaining in the dispenser.

14. The apparatus of claim 13, wherein the chemical product data includes at least one of a name of the chemical product, a type of the chemical product, a class of the chemical product, a concentration of one or more active ingredients in the chemical product, a weight of the chemical product, a volume of the chemical product, a viscosity of the chemical product, a density of the chemical product, a hardness of the chemical product, a shape of the chemical product, a color of the chemical product, and a specific gravity of the chemical product.

15. The apparatus of claim 13, wherein the chemical product data includes manufacturing information regarding the chemical product.

16. The apparatus of claim 15, wherein the manufacturing information includes at least one of a manufacturing date, a location, a serial number, a lot number, and shift information.

17. The apparatus of claim 13, wherein the at least one dispense parameter includes at least one of an amount of time to dispense the chemical product, an amount of time to dispense a diluent, a weight threshold, a volume threshold, a concentration threshold, and a pH threshold.

* * * * *